United States Patent [19]

Caughey

[11] Patent Number: 4,765,256

[45] Date of Patent: Aug. 23, 1988

[54] REINJECTION GASIFIER

[75] Inventor: Robert A. Caughey, Antrim, N.H.

[73] Assignee: New Hampshire Flakeboard, Inc., Antrim, N.H.

[21] Appl. No.: 122,254

[22] Filed: Nov. 18, 1987

[51] Int. Cl.[4] ..... F23G 5/12

[52] U.S. Cl. ..... 110/229; 110/165 R; 110/269; 110/329; 110/346; 48/111; 48/209

[58] Field of Search ..... 110/346, 229, 257, 269, 110/270, 165 R, 329, 230; 48/111, 209; 202/117

[56] References Cited

U.S. PATENT DOCUMENTS

| | | | |
|---|---|---|---|
| 456,732 | 7/1891 | Mey . | |
| 3,064,592 | 11/1962 | Eberhardt | 110/7 |
| 4,050,900 | 9/1977 | Hobbs et al. | 23/277 |
| 4,268,274 | 5/1981 | Caughey | 110/229 X |
| 4,270,899 | 6/1981 | Faulkner et al. | 432/58 |
| 4,308,034 | 12/1981 | Hoang | 110/229 X |
| 4,398,473 | 8/1983 | Loper | 110/329 X |
| 4,434,724 | 3/1984 | Kunkel, Jr. | 110/269 |

*Primary Examiner*—Edward G. Favors

*Attorney, Agent, or Firm*—Lahive & Cockfield

[57] ABSTRACT

A gasifier (10) for particulate combustible material in effect separates the pyrolysis and the oxidation of the flowable fuel material with a traveling grate (40) for advancing a bed of the material from a material feed station (40A) to a material discharge station (40B). A material feed mechanism (60) has fuel and ember chutes (62, 64) for depositing hot embers below combustible material. Discharge transport apparatus 70 separates ash from combustible residue, i.e., embers. A recirculation transport (80) delivers combustible residue to the ember chute (64) where it is reintroduced to the traveling grate (40) for a further transit through the gasifier (10).

22 Claims, 4 Drawing Sheets

REINJECTION GASIFIER

FIELD OF THE INVENTION

This invention relates to burners and gasifiers and to a processing system for combustible, particulate material.

BACKGROUND AND OBJECTS

In a conventional system for burning flowable biomass material, such as wood chips, to recover energy, the chips are spread on a grate below a combustion chamber. Combustion air is blown upward through the grate and the chips, and into the combustion chamber where, with the addition of more air, combustion is completed. In common practice, the total amount of air used may vary at least from 130% to 200% of the theoretical, stoichiometric requirement. Usually as much as 60% to 80% of the total amount of combustion air is injected through the grate.

The excess air above the stoichiometric requirement is generally considered desirable to enhance drying and ensure oxidation of the chips. The increased flow of air tends to fluidize the bed to some degree, giving the chips high exposure to hot gases and radiant heat. In addition, the excess air is considered desirable to cool the grate, to prevent overheating and to extend operating life.

Several disadvantages attend this operation. The amount of excess air may cause a significant reduction in efficiency and, therefore, require a larger system, and higher fuel consumption, for equivalent power output. Further, the turbulence in the fuel bed by the combustion air entrains excessive amounts of sparks and fly ash in the combustion gases. Also, the prior operation can cause sooting or slagging problems. To remedy this condition, expensive stack gas clean-up systems are used. The excessive volume of stack gas and the added pressure drop caused by the clean-up system increase the amount of energy required for moving the gases through the system and up the stack. This increases the required operating power, and decreases system efficiency.

Accordingly, an object of the invention is to provide an improved burner or gasifier for flowable, particulate combustible material.

Another object of the invention is to provide an improved burner or gasifier in which the conditions in the fuel bed are readily controlled, for example, for better efficiency and to avoid disturbance of the bed during combustion.

Yet another object of the invention is to provide a burner or gasifier in which air flow is limited to approximately the stoichiometric requirement for combustion.

It is also an object of the invention to provide a method and apparatus for the controlled pyrolysis of particulate combustible material and which operates with high efficiency and low particulate content in the gaseous discharge.

Another object is to provide a combustion method and apparatus which attain separation and control of pyrolysis and of oxidation of combustible particulate material.

Further objects of the invention are to provide an apparatus and method characterized by improvements in the combustion of flowable particulate bio-mass fuels, such as wood chips, by improving combustion efficiency, reducing size and capital cost of equipment, lowering operating power requirements, and cleaner exhaust gases.

SUMMARY OF THE INVENTION

These and other objects of the invention are achieved by a gasifier for flowable particulate combustible material and which has an endless transport disposed for movement within a chamber. The transport divides the chamber into a lower compartment below the transport and an upper combustion compartment above the transport. The transport preferably is in the form of an air-permeable traveling grate for advancing the material from a receive location to a discharge location. At the discharge location, ash and partially combusted residue of the material are discharged from the transport.

The gasifier further has charge introducing elements, commonly employing chutes. A first of these elements, for introducing fuel, delivers new flowable particulate material to the transport at the receive location. A second of these elements delivers hot embers to the transport at the receive location, so that the embers are on the transport underneath the new fuel material.

Another feature of the invention is a material discharge element which separates the partially combusted residue from ash at the discharge end of the transport, and transports the partially combusted residue, while still hot, to the second, ember-introducing element.

Another aspect of the invention is that the combustion within the gasifier is controlled, so that the fuel material pyrolytically decomposes into hot embers and emitted gases, substantially without significant oxidization, during a first pass through the gasifier. When the hot embers are recirculated and passed a second time through the gasifier, they are substantially fully oxidized. Thus, the invention attains a separation of the pyrolysis and the oxidation of the fuel material, and hence facilitates the separate control of each such operation.

According to a further aspect of the invention, a single combustion chamber or, alternatively, two separate combustion chambers, can be used to burn the gaseous combustion products, e.g. the volatiles. The volatiles from pyrolysis include organic gases as well as water vapor. Carbon monoxide is also present, from oxidation of carbon in the fuel material. In a first embodiment, primary combustion air is introduced into the lower compartment, and flows through the grate-like transport and the fuel material on it, and then into the combustion chamber. Secondary combustion air can be introduced selectively directly into the combustion chamber above the grate, in an amount sufficient to substantially fully oxidize the vapors. Excess air and combustion products, e.g. water vapor and carbon dioxide, exit from the combustion chamber at an exhaust port.

In a second embodiment, primary and secondary combustion of the combustible gases proceed in separate chambers. The primary combustion air is introduced into the lower compartment, flows through the grate and fuel material thereon, and to the primary combustion chamber. The exhaust from the primary combustion chamber is directed to a secondary combustion chamber, where secondary combustion air is added to complete combustion.

In either embodiment, the combustion of vapors is effected by the addition of an amount of secondary air adequate to ensure complete oxidation. Preferably the amount of primary and secondary combustion air is restricted substantially to the stoichiometric quantity required to complete the respective combustion process. The economic attainment of such substantially stoichiometric operation is a significant improvement. It can lead to higher efficiency, and cleaner exhaust gases, among other features.

According to a further aspect of the invention, a barrier mechanism is provided within the gasifier chamber proximal to the discharge end for engaging the material advancing on the grate for controlling the discharge of material. In addition, the mechanism aids in controlling primary air flow. The chamber has a passage which affords air communication between the upper and lower compartments at the discharge end of the grate. The barrier mechanism is disposed to selectively block the passage.

Another aspect of the invention is directed to a variation of the above-described charging elements in which an optional third such element is provided for selectively introducing a third material to the grate. In one preferred practice, the third material is non-combustible, insulative granules which are delivered directly to the grate, and are covered first by the recirculated embers and then by the new fuel material. The insulative material extends the life of the grate by insulating it from the hot embers, and it can enhance control of the air flow through the bed of material.

The invention also embraces the method of gasification with which the foregoing apparatus operates.

BRIEF DESCRIPTION OF THE DRAWINGS

For a fuller understanding of the features, advantages and objects of the invention, reference should be made to the following detailed description and the accompanying drawings, in which.

DESCRIPTION OF THE ILLUSTRATED EMBODIMENTS

Figure 1:
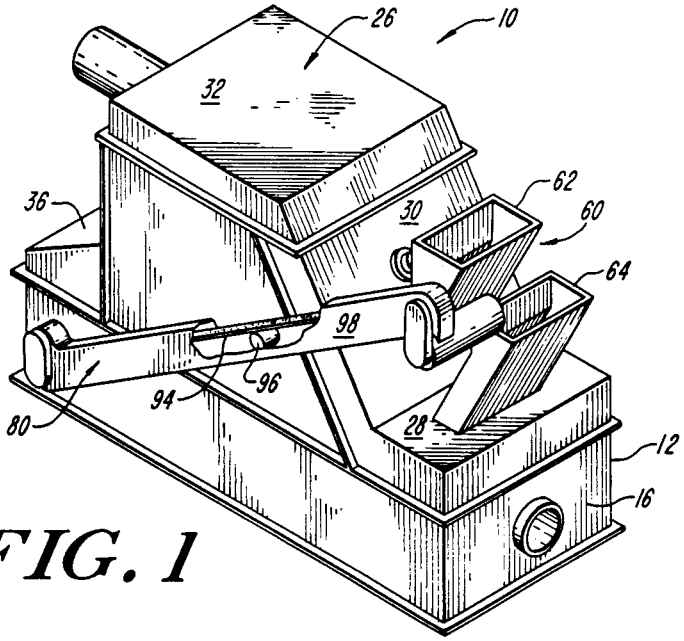
FIG. 1 is a perspective view of a reinjection gasifier in accordance with one practice of the invention.
Figure 2:
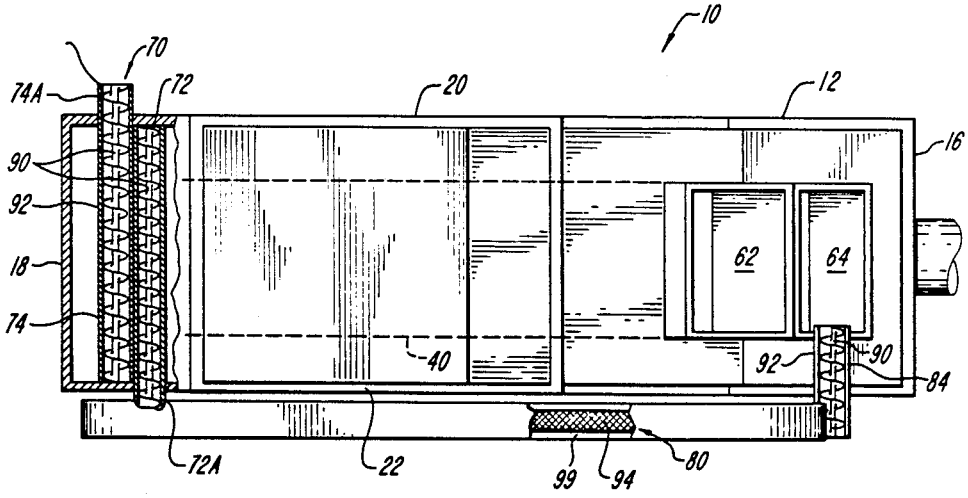
FIG. 2 is a top plan view, partially in section, of the reinjection gasifier of FIG. 1.
Figures 3, 3A, 5:
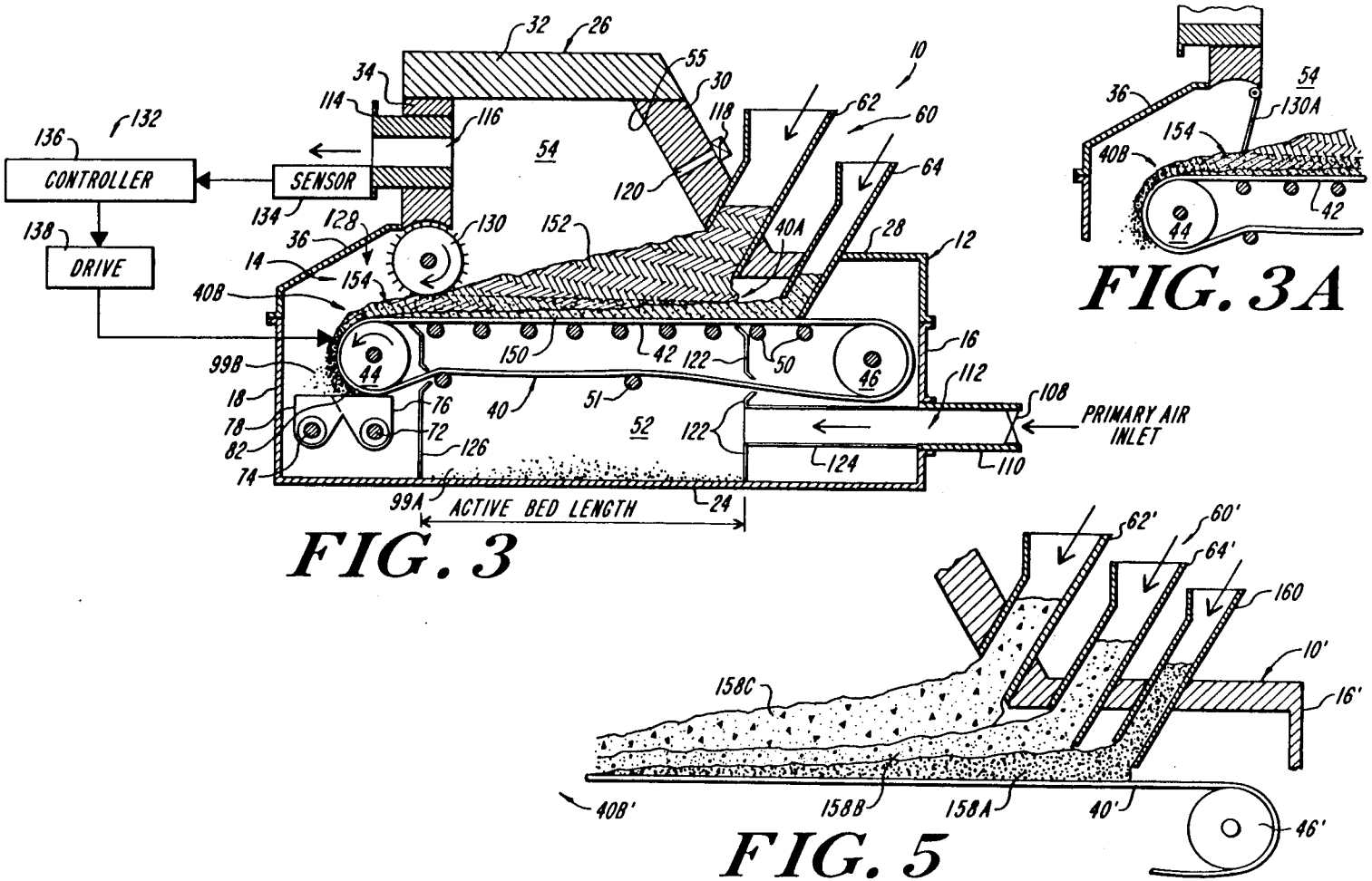
FIG. 3 is side elevation view, in section, of the gasifier of FIG. 1.
FIG. 3A is a fragmentary view similar to FIG. 3 and showing an alternative barrier element.
FIG. 5 is a partial side elevational view of a reinjection gasifier showing a charge feed in accordance with another embodiment of the invention.

FIGS. 1–3 show a burner or gasifier 10 in accordance with the invention and which has an enclosure or housing 12 forming a gasifier chamber 14. More specifically, the illustrated housing 12 has spaced, generally parallel front and back walls 16, 18 bridging spaced, generally parallel side walls 20, 22, which are also spanned by a planar bottom wall 24 and a contoured top wall 26. The illustrated top wall 26 has a generally horizontal first portion 28 endwise connected between the back wall 18 and an inclined second portion 30, a generally horizontal third portion 32 endwise connected between the inclined second portion 30 and a vertical fourth portion 34, and a declined fifth portion 36 endwise connected between the vertical fourth portion 34 and the front wall 18.

Within the housing 12 of the gasifier 10 is a material-transporting, air-pervious, traveling grate 40, preferably in the form of an endless, horizontally-elongated conveyor. Preferably, the illustrated traveling grate 40 substantially spans longitudinally between the front and back walls 16, 18 and laterally between the side walls 20, 22 of the housing 12. At any instant of time, the traveling grate 40 includes a top horizontal flight 42 (FIG. 3) which extend longitudinally for movement between a feed or receive location 40A and a discharge location 40B. The traveling grate 40 typically employs a woven wire mat of stainless steel or other heat and oxidation resistant metal. Motor-driven, spaced first and second main sprocket rollers 44, 46 disposed respectively proximate the feed and discharge locations 40A, 40B of the top flight 42 drivingly engage an internal surface 48 of the traveling grate 40. A plurality of spaced support rollers 50 support the top flight 42, and a second set of one or more spaced support rollers 51 supports the balance of the traveling grate 40.

The traveling grate 40 divides the gasifier chamber 14 into a first, lower compartment 52 below the grate 40, and a second, upper compartment 54 above the grate 40. The upper compartment 54 forms a combustion chamber 55. The walls of the housing 12 enclosing the combustion chamber 55 preferably are refractory lined.

Above the receive location 40A of the traveling grate 40 of the gasifier 10 is a charge feed mechanism 60 for introducing material to the top flight 42 of the traveling grate. The illustrated feed mechanism 60 includes a fuel chute 62 and an ember chute 64. The fuel chute 62 introduces uncombusted fuel, such as dried wood chips or other combustible bio-mass material in chip-like or other flowable particulate form, to the traveling grate 40. The ember chute introduces hot, partially oxidized embers to the traveling grate 40. The ember chute 64 is located nearer the front wall 16 than is the fuel chute 62 so as to deposit the embers first, and hence underneath the fuel, on the top flight 42 of the grate 40.

The illustrated fuel and ember chutes 62, 64 extend substantially in parallel and at an inclined angle through the housing top wall 26. As shown, each has a flared end 66 outside the housing 12 for receipt of fuel in the case of the fuel chute 62, and embers in the case of the ember chute 64. The feed mechanism 60 can include an air control element (not shown) in each chute to block passage of air into the compartment 54 when the chute is empty.

After the transport advances fuel material from the receive location 40A to the discharge location 40B, the residual material is discharged from the traveling grate by dropping it onto a discharge transport assembly 70. The illustrated discharge transport assembly 70 has motor-driven first and second augers 72, 74 for removing the discharged materials. The two augers 72, 74 are disposed normally below the discharge location 40B, and adjacent one another along parallel axes which extend preferably transverse to the direction of motion of the traveling grate 40. A discharge end 72A, 74A of the respective first and second augers 72, 74 extends through one housing side wall 22, 20, respectively. Alternatively, the discharge transport assembly 70 can employ discharge conveyors, shuttles or other known transport devices.

With reference to FIG. 3, the illustrated discharge assembly 70 further has two side-by-side troughs 76 and 78 located below the forward, discharge end of the traveling grate 40. The front trough 76 receives heavier residue and hence receives embers of the fuel material, whereas lighter residue, e.g. ash, spills into the back trough 78. A separating plate 82, shown with broken line, is adjustably mounted between the troughs, to form the dividing wall between them. The separating plate is positioned to enhance the separation of residue into embers that fall into trough 76 and ash that falls into trough 78.

The first auger 72 is mounted to engage and remove embers in the ember trough 76, and the second auger 74 is arranged to remove ash that collects in the ash trough 78.

One alternative structure (not shown) for the discharge transport assembly 70 deposits all residue from the grate 40 into an upper trough, from which an auger or like transport removes embers. The upper trough has an apertured, screening bottom wall through which ash drops to a second, lower trough for removal.

In further accordance with the invention as illustrated, embers are removed from the housing 12 by the first auger 72, which transports the embers through the housing side wall 22, and delivers them to an ember recirculation transport 80. The recirculation transport 80 conveys the embers upwardly in the general direction toward the mouth of the ember chute 64 for reintroducing the embers to the traveling grate 40. The illustrated recirculation transport 80 is an inclined conveyor that transports embers from the first auger 72 in an upward and frontward direction for delivery to the ember chute 64. As illustrated, a third auger 84 provides a transport that spans between the upper, discharge end of the recirculation transport 80 and the chute 69 for transporting the embers laterally to the ember feed chute 64.

Each illustrated recirculation auger 72 and 84 includes an auger screw 90 supported for rotation within an auger housing 92. The illustrated recirculation conveyor 80 includes a driven endless, preferably cleated conveyor belt supported by rollers and preferably enclosed by a gas-tight conveyor housing 98.

Ash can be removed from the gasifier 10 in several ways. In the illustrated gasifier, a portion 99A (FIG. 3) of the ash falls through the traveling grate 40 and collects on the bottom wall 24, for ready removal. Another portion 99B of the ash is received by the second auger 74 for discharge through the ash port 100 (FIG. 6) extending through the housing side wall 20. Ash discharged from the grate 40 can also enter the recirculation transport, which returns it to the upper flight of the grate, together with embers.

The combustion airflow system for the gasifier 10 provides a regulated amount of combustion air through the grate as well as directly into the combustion chamber 55.

As shown diagrammatically in FIG. 3, a control valve 108 regulates air flow through a primary air inlet duct 110. The illustrated inlet duct 110 extends through the housing front wall 16 and defines a primary air inlet port 112 for introducing primary combustion air into the lower compartment 52 below the traveling grate 40.

The introduced air flows through the traveling grate 40 and exits from the housing top wall 26 through a flanged exhaust duct 114 defining an exhaust port 116. The illustrated exhaust port 116 is in the vertical fourth portion 34 of the top wall 26.

As also shown in FIG. 3, the illustrated airflow system has a valved secondary air inlet duct 118, which defines a controlled secondary air inlet port 120, which feeds directly to the upper compartment 54. The secondary air inlet duct 118 extends through the inclined second portion 30 of the top wall 26 of the housing 12 at a location above the traveling grate 40 and closer to the receive location 40A than to the discharge location 40B of the traveling grate 40.

Proximate the discharge location of the traveling grate 40 is a barrier mechanism 130 for controlling the discharge of material from the traveling grate 40. In addition, the mechanism 130 aids in controlling air flow. The gasifier chamber 14 has a passage 128 which affords air communication between the upper and lower compartments 52, 54 at the discharge end 40B of the traveling grate 40. The barrier mechanism 130 is disposed to selectively block the passage 128. Preferably, the barrier mechanism 130 employs a roller of overall cylindrical shape and preferably having outer radially-extending annular fins, blades or other projections for avoiding a build-up ash or slug on the transport. The roller mechanism is mounted to the housing and driven for rotation, as indicated, to provide a peripheral surface which contacts material advancing on the grate upper flight and which is moving in the same direction as the advancing material. The roller barrier mechanism 130 preferably is driven so the surface thereof moves slightly faster than the advance of the grate 40. This barrier and control mechanism restricts and thereby controls the passage of air from the lower compartment 52 to the upper one 54, and it assists the discharge of residue of the fuel material from the moving grate 40.

As further shown in FIG. 3, the chamber 14 preferably has an internal baffle structure that directs primary air to a limited active length of the transport grate 40. The illustrated baffle structure includes a front baffle wall 122 through which primary air enters by way of a duct extension 124 coupled with the inlet duct 110. The grate lower flight passes through the front baffle wall 122 at an aperture that preferably is fitted with roller or wiping seals (not shown). The front baffle wall is located to restrict primary air from entering the grate upper flight 42 at the frontal location where embers are deposited and where fresh fuel is deposited. It hence directs primary air to the upper flight after both embers and fresh fuel material are deposited.

A back baffle wall 126 restricts primary air from the upper flight 42 at the discharge location 40B. The illustrated location of the back baffle wall 126 coincides substantially with the location, along the upper flight, of the barrier mechanism 130. The grate lower flight passes at an aperture, preferably sealed, through the back baffle wall 126.

The active length of her grate upper flight 40 is hence between these baffle walls. Further, the barrier walls define the longitudinal extent of the primary chamber 52, as shown.

With further reference to FIG. 3, the illustrated gasifier 10 has a feedback system 132 that can control operation with regard to several parameters. In the illustrated example the system controls the speed of the traveling grate 40. A sensor 134 operatively associated with the exhaust duct 114 monitors the temperature of the exhaust gases and applies a temperature-responsive signal to a controller 136. The controller operates a drive device 138 that rotationally drives one grate-advancing roller 44. This control arrangement is illustrative, for the gasifier 10 can alternatively or additionally have sensors to monitor various parameters, including primary and/or secondary air inlet flow, grate speed, ember volume, ash volume, exhaust gas particulates and/or temperatures within the bed of material to attain selected operation. The primary air inlet flow rate is of interest, for example, to control back pressure on the traveling grate 40 resulting from the oxidation of embers, to avoid reverse flame jets and grate hot spots and thereby to extend grate life.

In the operation of the gasifier 10, uncombusted fuel material is deposited by the fuel chute 62 onto the traveling grate 40 above hot embers for advance from the receive location 40A to the discharge location 40B. The fuel feed rate is, generally speaking, coordinated with the primary air supply and the speed of the traveling grate to control the combustion process. This process attains pyrolysis of fuel material during a first passage on the grate top flight 42 and oxidizes the resultant embers during a second such passage; the recirculation of the embers that result from the first passage initiates the second passage. Preferably the pyrolysis of the fuel is nearly complete, and the oxidation of the fuel has not proceeded to a significant degree, by the time the material traverses the longitudinal extent of the grate top flight 42 and reaches the discharge location 40B. Thus, the discharged solid material after a single pass through the gasifier 10 is embers of charcoal, with substantially all volatiles driven off. The volatiles, for example, typically account for 65% of the dry weight in the case of wood chips, with the residue being charcoal, i.e. carbon.

The discharged embers drop from the traveling grate 40 to the first auger 72 for delivery to the recirculating transport 80. That transport carries the material to the ember chute 64, deposits it once again on the traveling grate 40 at the receive location 40A. As the traveling grate 40 advances the embers beneath the fuel chute 62, fresh fuel material is deposited over them. The flow of primary air through the primary air inlet port 112 supports further oxidation of the layer of embers. The generated heat passes upward, initiating drying and pyrolysis of the new fuel material above the embers.

The use of the air-permeable wire mesh for the traveling grate 40 assures a well distributed air flow into the fuel bed, with minimal disturbance of the fuel.

The recirculated embers undergo substantially complete oxidation in the traverse from the receive location 40A to the discharge location 40B, and the overlying fuel material undergoes substantial drying and pyrolysis. All material on the grate top flight 42 is discharged to the discharge transport assembly 70, at the discharge location. The second auger 74 removes the ash residue. All residue other than ash, and typically consisting of pyrolyzed fuel material and embers, is recirculated. Upon complete oxidation, the ember carbon content is converted to carbon monoxide, carbon dioxide and ash residue.

In this fashion, the gasifier of the invention separates the pyrolyzation of flowable combustibles from the oxidation of it, in effect with a "two pass" operation.

Figure 4:
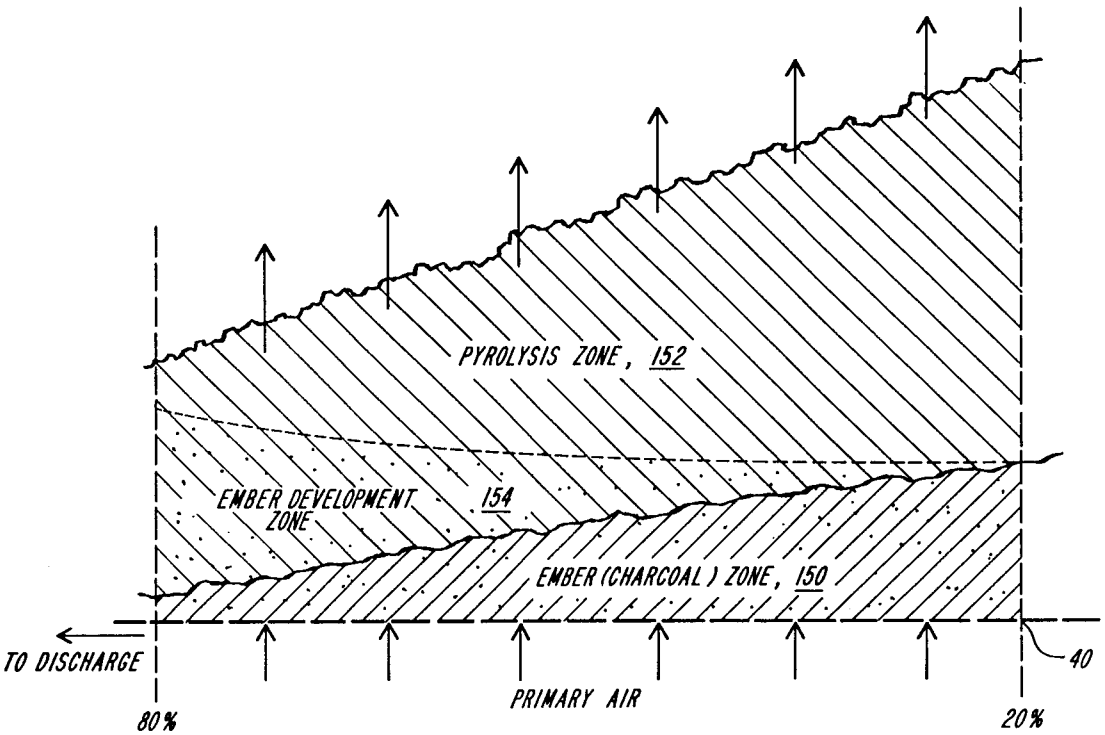
FIG. 4 is a graphic illustration of a typical fuel bed being combusted in the reinjection gasifier of FIG. 1.

FIG. 4 illustrates in further detail the operation of the illustrated gasifier 10 with regard to reactions within the bed of material on the grate upper flight 42, showing typical conditions at locations representing approximately 20% to 80% of the travel distance along the active length, i.e. between the baffle walls 122 and 126. The drawing depicts the recirculated embers, as deposited on the grate at the chute 64, as forming an ember zone 150 which is below a pyrolysis zone 152 formed by newly deposited fuel material from the chute 62. At the 20% location, i.e. at the right side of FIG. 4, newly deposited fuel in the zone 152 is heating to pyrolysis temperature and the ember zone 150 is at maximum depth. Carbon in the embers of the zone 150 is oxydized to carbon dioxide primarily at a lower level of the zone 150, i.e. just above the grate. As the resultant hot combustion gas rises, the oxygen in it is depleted and an excess of carbon prevails. Where the temperature is sufficiently high, newly formed carbon dioxide is reduced to carbon monoxide consuming carbon from the embers and extracting heat, up to the level where carbon dioxide reduction no longer occurs.

During one typical operation with wood chips, the temperature in the bed of material on the grate at the 20% location is in the order of 1000° Fahrenheit adjacent the top of the ember zone 150 and in the order of 400° Fahrenheit at the top of the Pyrolysis zone 152. At the 80% location, i.e. the left side of FIG. 4, these temperatures are in the order of 2000° Fahrenheit and 1000° or greater, respectively.

Above the level where the rising combustion gas has insufficient oxygen to support oxidation of carbon or reduction of carbon dioxide, the ascending gas provides sufficient heat to promote pyrolysis in the fresh fuel in the zone 152. The volatiles emerging from the top of the bed at this point, i.e. at the 20% location and closely thereafter, are relatively cool. A small volume of combustion air is typically added to provide secondary combustion to maintain the secondary compartment 54 sufficiently hot to avoid the precipitation of creosote or coke on the refractory-lined chamber walls.

As the grate advances the fuel material toward the discharge end, i.e. to the left in FIG. 4, the pyrolysis zone 152 shrinks in depth, as also occurs in the ember zone 150. Correspondingly, the temperature of the combustion gas rising from the ember zone into the pyrolysis zone increases. Hence the formation of embers in the new fuel penetrates further into the pyrolysis zone 152. This formation of new embers in indicated in FIG. 4 with an ember development zone 154.

At the 80% location, i.e. close to the discharge location at the left side of FIG. 4, the pyrolysis of newly delivered fuel material is substantially complete and the ember development zone 154 extends substantially through the depth of that zone. Correspondingly, oxidation is essentially complete in the ember zone 150, with only an ash residue remaining on the grate.

Ideally, the depth of the fuel bed at the discharge location, i.e. at the end of the active length, is such that at the top of the bed the temperature of exiting gas is sufficiently low so that the carbon dioxide reduction reaction has ceased.

Under these conditions, the total fuel consumption is governed principally by the amount of primary air supplied through the primary chamber 52. The gasifier accordingly is operating with substantially stoichiometric primary gas consumption.

The continuous introduction of cold ambient air for the primary combustion, and the delivery of it throughout the length and width of the grate along the active length maintains the grate temperature at a safe operating temperature for long grate life.

The off-gas from the pyrolysis zone 152 preferably is mixed with secondary combustion air, which burns the carbon monoxide and other carbon distillates. This secondary combustion can occur in the combustion chamber 55 or, alternatively, in a separate secondary combustion chamber. The system shown in FIG. 6, and described further below, illustrates such a separate secondary combustion chamber 155, with a secondary air inlet 156.

More particularly, the supply of primary air is determined, e.g. with the valve 108, to attain the desired rate of fuel consumption and correspondingly heat energy production. Preferably, a stoichiometric relation is maintained between air supply and fuel consumption. The waste gases hence have minimal excess oxygen. The input hoppers of the chutes 62 and 64 are usually maintained with a supply of fresh fuel chips and embers, respectively. The rate of grate advance, and the secondary air supply, typically are governed by the primary air supply. Another aspect of optical operation maintains the grate upper flight covered throughout with fuel material, to retard and restrict the primary air flow from entraining ash particles. Hence the waste gases remain clean.

FIG. 3A shows that a simpler form of barrier mechanism for the gasifier 10 employs a hinged barrier gate 130A, in place of the roller mechanism of FIG. 3. The illustrated hinged gate depends from the wall portion 34 and sweeps across the advancing material on the grate upper flight.

FIG. 5 illustrates a practice of the invention with added thermal protection of the traveling grate 40 and further control of the combustion process by passing the primary air through a thermally insulative layer 158A of incombustible material on the traveling grate 40. The insulative layer 158A is immediately below the embers 158B which, in turn, underlie the newly-deposited fuel material 158C. To that end, a gasifier 10' has, in addition to a fuel chute 62' and an ember chute 64', a third chute 160 for introducing the insulative material to the top flight of the grate 40'. (Elements in FIG. 6 which correspond to elements of the gasifier 10 as shown in FIGS. 1–3 bear the same reference numeral with an apostrophe.) The third chute 160, as shown, is disposed nearer than the ember chute 64' to the housing front wall 16. Thus, the ember chute 64' is disposed between the fuel chute 62' and the insulation chute 160.

The gasifier 10' can operate with various insulative material, which those skilled in the art can select depending at least in part on the fuel material being burned. It has been found, for example, that a 0.5 inch (1.27 cm) layer of sintered ash particles of approximately 0.125 to 0.250 inches (0.33 to 0.65 cm) screen size can protect the traveling grate 40 even when the introduced air flow is increased to a level well beyond the limit conventionally deemed suitable for maintaining acceptably-low particulate entrainment during operation with a wood-chip fuel material.

In another example, the burning of shredded automobile tire scrap is improved by an underlying insulative material, preferably of clay. Limestone can be added to absorb sulfur. Wood chips can be mixed with the shredded tire material to dilute the rubber content of the fuel material. The gasifier 10' can include elements which recover insulative material which falls through the grate 40' and which is discharged at the end 40B', and which separate it from ash and from embers, as desired, for recirculation to the chute 160.

Figure 6:
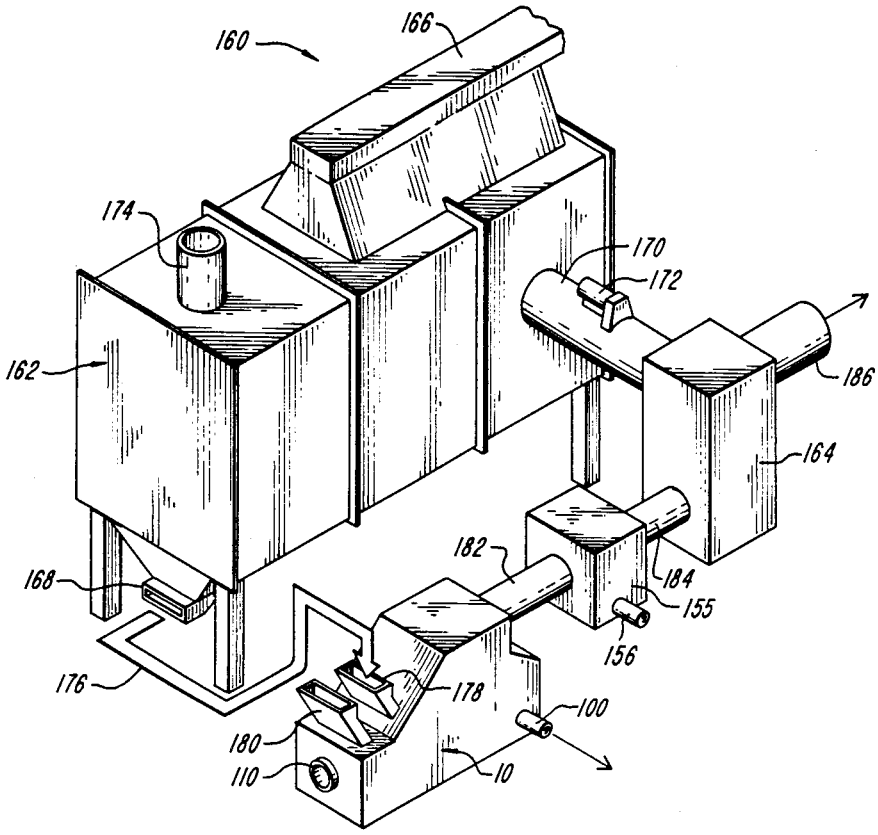
FIG. 6 is a perspective view of a processing system incorporating a gasifier in accordance with the invention.

A gasifier in accordance with the invention can be incorporated readily into a complete processing system for gasifying chip-like material, as FIG. 6 shows. The illustrated processing system 160 incorporates the gasifier 10 of FIGS. 1–3, a continuous dryer 162, the secondary combustion chamber 155, and a boiler 164. The system can process various chip-like or other particulate and flowable, combustible material, including for example, wood chips and pelletized paper-making sludge.

The illustrated dryer 162 receives green chips through a chip feed mechanism 166, and discharges dried chips, having a water content of approximately 12% to 15%, at a discharge duct 168.

The illustrated system achieves drying by passing warm flue gas from the boiler 164 through the green chips in the dryer 162. The gas is introduced into the dryer at a gas inlet 170, preferably driven at a predetermined velocity or flow rate by a controllable fan 172. The cooled, humidified gas is discharged from the dryer 162 through a gas exhaust 174, suitably to atmosphere. The supply fan 172 can be regulated in accordance with a feedback signal that is responsive to an operating parameter of the dryer 162.

The gasifier 10 of FIG. 6 has a fuel inlet 178 that receives dried chips from the dryer chip discharge 168, as designated with fuel path 176. An ember inlet 180 receives hot embers, preferably recirculated from within the gasifier 10. Ash is removed from the gasifier at the ash discharge port 100. A gas conduit 182 directs the gaseous products of the pyrolysis within the gasifier 10 to a secondary combustion chamber 155. A second gas conduit 184 is connected from the secondary chamber to the boiler 164. The exhaust from the boiler is fed in part to the dryer gas inlet 170 and in part through an exhaust conduct 186 for other utilization of the hot exhaust gas, for example, for heating, power generation or industrial processes.

The commonly-assigned application for patent, Ser. No. 122,045, entitled "Dryer for Combustible Chip-like Material" describes a preferred dryer 162 in further detail.

The invention can be embodied in other forms within the spirit and characteristics thereof described above and shown in the drawings. The described embodiments of the invention are illustrative, and the scope of the invention is indicated in the appended claims. All changes which come within meaning and range of equivalency of the claims are therefore intended to be embraced therein.

Having described this invention, what is claimed as new and secured by Letters Patent is:

1. Gasifier apparatus for particulate combustible material, said apparatus comprising A. means forming a gasifier chamber, B. material-transporting grate means for supporting particulate material within said chamber for pyrolysis and for transport from a receive location to a discharge location, where residue of the particulate material is discharged from the grate means, C. feed means for introducing particulate material to the grate means at said receiving location, D. means for introducing primary air to the particulate material on said grate means, E. recirculating means for returning at least a portion of said residue discharged from the grate means to said grate means at said receive location, and F. outlet means for the passage of combustible vapors from said combustible material outward from said chamber.

2. Gasifier means according to claim 1 further comprising

A. means for separating ash residue discharged from said grate means from combustible residue discharged from said grate means for delivering said combustible residue to said residue recirculating means, and B. means for receiving ash residue and for removing it from said chamber.

3. Gasifier apparatus according to claim 1

A. in which said recirculating means includes means for returning combustible residue to said grate means prior to introduction of particulate material to the grate means by said feed means, and B. whereby recirculated combustible residue is on said grate means beneath particulate material received from said feed means.

4. Gasifier apparatus according to claim 1 in which

A. said grate means is air pervious, and

B. said primary air introducing means delivers primary air to the particulate material upward through the grate means.

5. Gasifier apparatus according to claim 1 further comprising control means within said chamber for engaging material advancing on said grate proximal to said discharge location for controlling material delivery to said discharge location.

6. Gasifier apparatus according to claim 1 in which

A. said grate means extends at least partially horizontally between said receive location and said discharge location, B. said gasifier chamber has a first compartment below said grate means and a second compartment above said grate means and in communication with said outlet means, and C. said primary air introducing means introduces primary air to particulate material on said grate means by way of said first compartment for rising through said material on said grate means to said second compartment.

7. Gasifier apparatus according to claim 6

A. in which said chamber has means forming a passage which affords air communication between said first and second compartments at said discharge location of said grate means, and B. further comprising barrier means within said chamber engaging material on said grate means proximal to said discharge location for controlling material discharge from said grate and for at least partial blockage of air flow between said first and second compartments at said chamber passage.

8. Gasifier apparatus according to claim 1

A. in which said feed means includes a first feed element for delivering a first selected flowable solid to said grate means at said receive location for overlying residue recirculated to said grate means and includes a second feed element for delivering a second selected flowable solid to said grate means for underlying the residue on said grate means, and B. wherein said feed means delivers particulate combustible material to at least one of said first and second feed elements.

9. Gasifier apparatus according to claim 8 further comprising means for delivering a selected flowable non-combustible solid to the other of said first and second feed elements, for selectively introducing a non-combustible material selectively located on said grate means relative to said residue.

10. Gasifier apparatus according to claim 1 further comprising

A. means for sensing an operating parameter of the gasification of particulate material on said grate means, and B. feedback control means for receiving an operation-responsive signal from said sensing means and for controlling at least one of the grate means and said primary air delivery means in response thereto.

11. Gasifier apparatus according to claim 10 in which said sensing means include means for sensing a parameter selected from temperature of volatile gases discharged from particulate material on said grate means and a measure of combustible residue discharged from said grate means.

12. Gasifier apparatus according to claim 10 in which said feedback control means includes means for controlling at least one operating condition selected from the transport speed of said grate means and the volume of primary air said air-introducing means delivers.

13. Gasifier apparatus according to claim 1 in which said grate means includes an endless transport belt having an upper flight that receives and transports said particulate material and recirculated residue for said advance from said receive location to said discharge location.

14. A method for gasifying particulate combustible material comprising the steps of A. advancing particulate combustible material within a gasifier chamber on a material-transporting grate means from a receive location to a discharge location, B. pyrolyzing the particulate combustible material on said grate means during said advance between said receive and discharge locations, C. discharging residue of the particulate material from said grate means at said discharge location, D. recirculating combustible residue discharged from said grate means at said discharge location to said grate means at said receive location, and E. feeding fresh particulate combustible material to said grate means at said receive location for overlying recirculated combustible residue on said grate means.

15. A method according to claim 14 further comprising the step of delivering a selected restricted volume of air to material on said grate means sufficient for said pyrolysis and insufficient for complete oxidation of the combustible material on said grate means.

16. A method according to claim 14 further comprising the step of delivering to material on said grate means a selected volume of air restricted substantially to stoichiometric quantities for partial oxidation of combustible material.

17. A method according to claim 14

A. in which said advancing step includes providing said grate means as an endless transport, and B. including the step of delivering primary air to material on said grate means with selected spatial distribution along the width and the length of said endless transport.

18. A method according to claim 14 further including advancing material on grate means formed by an endless transport belt having an upper flight that receives and transports said particulate material and recirculated residue for said advance from said receive location to said discharge location.

19. A method according to claim 14 further comprising the step of restricting the entrainment of particulates with gas exiting from material on said grate means.

20. A method according to claim 19 in which said entrainment restricting step includes the step of delivering air to combustible material on said grate means with flow controlled for restricting the entrainment of particles.

21. A method according to claim 14 further comprising the steps of

A. sensing an operating parameter of the gasification of particulate material on said grate means, and B. controlling the pyrolysis of particulate combustible material on the grate means in response to said sensing of gasification operation.

22. A method according to claim 14 further comprising the step of providing controllable barrier means engaging material on said grate means proximal to said discharge location.

* * * * *